US006125785A

United States Patent [19]

Asheri

[11] Patent Number: 6,125,785

[45] Date of Patent: Oct. 3, 2000

[54] BELL ASSEMBLY

[75] Inventor: Michal Asheri, Mevaseret, Israel

[73] Assignee: Dania Plastic Parts Ltd., Or Yehuda, Israel

[21] Appl. No.: 08/942,669

[22] Filed: Oct. 2, 1997

[51] Int. Cl.[7] ..... G10K 1/06

[52] U.S. Cl. ..... 116/148; 116/155; 116/167

[58] Field of Search ..... 116/171, 148, 116/149, 150, 153, 154, 155, 156, 157, 158, 160, 172, 166, 161, 167; 84/406

[56] References Cited

U.S. PATENT DOCUMENTS

| | | | |
|---|---|---|---|
| 247,610 | 9/1881 | Butler | 116/155 |
| 403,286 | 5/1889 | Peck | 116/155 |
| 770,437 | 9/1904 | Mayland | 116/149 |
| 4,220,112 | 9/1980 | Neilsen | 116/63 R |
| 4,457,050 | 7/1984 | Kanzaka | 24/108 |
| 4,534,088 | 8/1985 | Ricke | 24/295 |
| 4,827,243 | 5/1989 | Cheng | 341/22 |
| 5,631,881 | 5/1997 | Pessey et al. | 368/290 |
| 5,673,887 | 10/1997 | Hollingsworth et al. | 248/220.31 |

*Primary Examiner*—Andrew H. Hirshfeld
*Assistant Examiner*—R. Alexander Smith

[57] ABSTRACT

A bell assembly in which the bell is mounted on a plastic base by means of a plastic collar snap-fitted into aligned holes in the bell and the bell mounting element of the base. The collar is formed with an axial bore for receiving a plastic manually depressible actuator.

20 Claims, 2 Drawing Sheets

FIG. 1
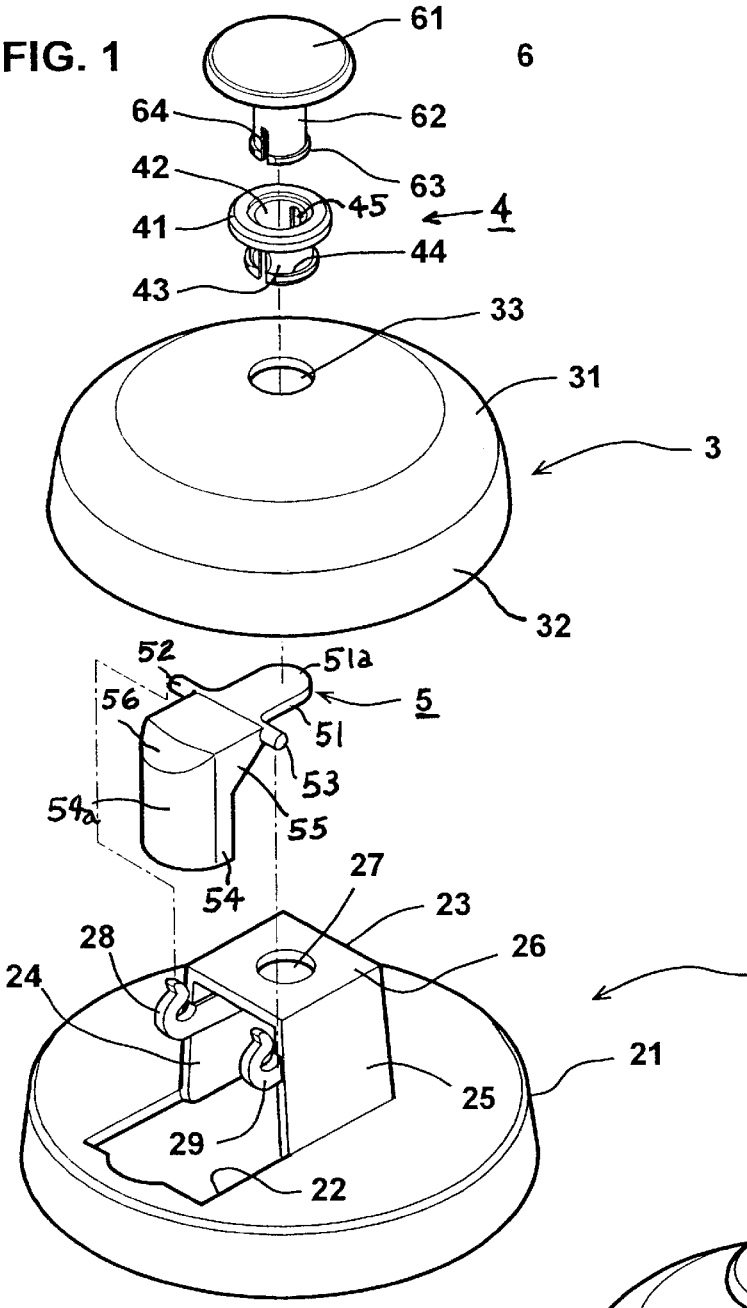
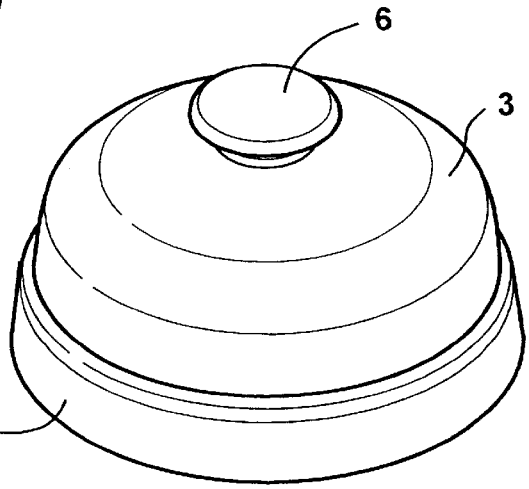
FIG. 2

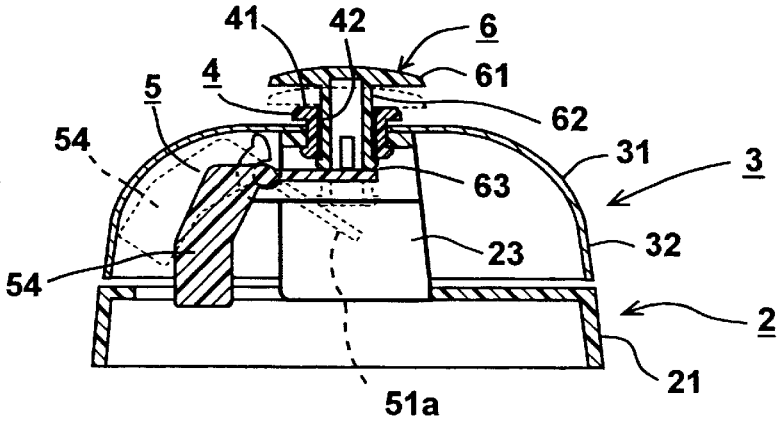
FIG. 3
FIG. 4
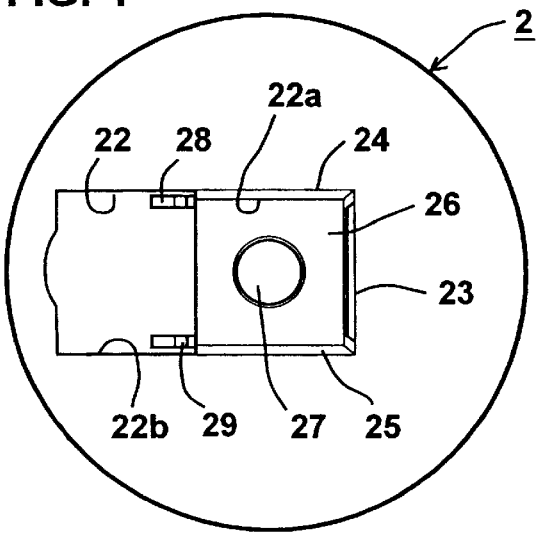
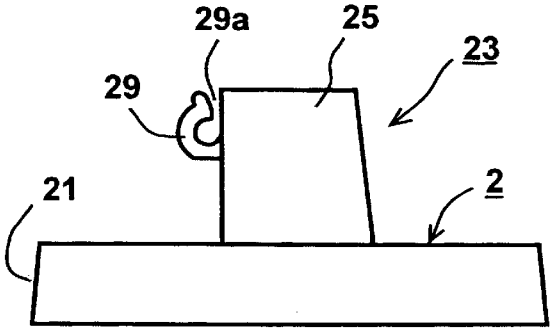
FIG. 5
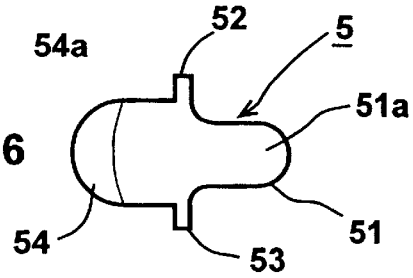
FIG. 6
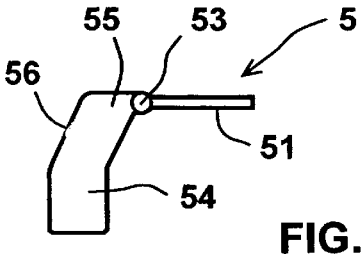
FIG. 7
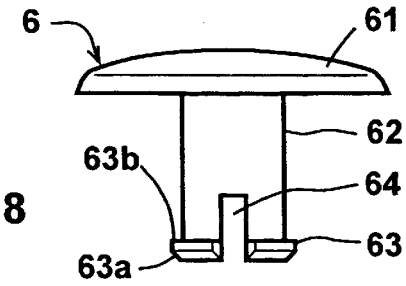
FIG. 8
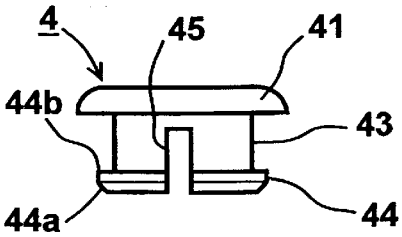
FIG. 9

BELL ASSEMBLY

FIELD AND BACKGROUND OF THE INVENTION

The present invention relates to bells, and particularly to the small portable type having a flat base enabling it to be supported on a flat horizontal surface and to be actuated by manually depressing an actuator projecting from the top of the bell.

Bells of the foregoing type are generally made completely of metal. The parts are therefore relatively costly to produce and to assemble, and therefore such bell constructions are generally not amenable to volume production at low cost.

OBJECT AND BRIEF SUMMARY OF THE INVENTION

An object of the present invention is to provide a bell assembly of a construction which permits most of its parts to be made of a plastic material, and which also permits the parts to be easily assembled in a quick and facile manner, thereby better enabling low-cost volume production of such bell assemblies.

According to one broad aspect of the present invention, there is provided a bell assembly, comprising: a base having a bell-mounting element: a metal bell mounted on the bell-mounting element of the base; a hammer pivotally mounted on the base and pivotal, when actuated, to strike the bell; and a manually depressible actuator mounted on the base and manually depressible to actuate the hammer to strike the bell; characterized in that the bell is mounted on the base by means of a plastic collar snap-fitted into aligned holes in the bell and bell mounting element of the base. The plastic collar has a stem passing through the aligned holes in the bell and bell mounting element in the base. One end of the stem is formed with an enlarged head engaging the outer surface of the bell; and the opposite end of the stem is formed with an annular rib slightly larger than the aligned holes permitting the opposite end of the stem to be forcefully inserted with a snap-action fit through the aligned holes. The collar is also formed with an axial bore for receiving the manually depressible actuator.

According to further features in the described preferred embodiment, the annular rib has a tapered surface on the side thereof facing away from the enlarged head to facilitate the forceful insertion of the collar through the aligned holes, and a flat surface on the opposite side, which flat surface is perpendicular to the stem axis, to prevent the forceful removal of the collar from the aligned holes. In addition, the stem is formed with at least one, preferably two, axial slit terminating short of the enlarged head to further facilitate the forceful insertion of the collar through the aligned holes.

According to further features in the described preferred embodiment, the actuator is a plastic button snap-fitted into the axial bore of the collar. The plastic button includes a stem longer than the stem of the collar to permit axial movement of the button within the collar in order to actuate the hammer. The plastic button further includes an enlarged head at one end of the stem manually engageable by a user to actuate the hammer, and an annular rib at the opposite end of the stem limiting the outward movement of the plastic button.

According to still further features in the described preferred embodiment, the base is also of plastic material, and the bell-mounting element thereof is a bridge integrally formed with the base. The bridge includes a pair of upstanding legs joined at one of their ends to the base. The pair of upstanding legs are joined at their opposite ends by a flat ledge formed with the hole aligned with the hole in the bell and bell mounting member receiving the plastic collar. The opposite ends of the upstanding legs are integrally formed with laterally-extending hooks for pivotally mounting the hammer.

According to still further features in the described preferred embodiment, the hammer is also of plastic material. Thus the hammer is formed with a mounting section having one end aligned with the depressible actuator, and a pair of projections at the opposite sides for pivotally mounting the hammer on the hooks of the base. The hammer is integrally formed with an impact section joined to the mounting section for impacting the bell when the hammer is pivotted by the depressible actuator.

As will be described more particularly below, such a construction permits most of the parts of the bell assembly to made of plastic material, thereby enabling low-cost, volume production and assembly of the bell assembly.

Further features and advantages of the invention will be apparent from the description below.

BRIEF DESCRIPTION OF THE DRAWINGS

The invention is herein described, by way of example only, with reference to the accompanying drawings, wherein:

FIG. 1 is an exploded, perspective view illustrating the parts one form of bell assembly constructed in accordance with the present invention;

FIG. 2 illustrates the bell assembly of FIG. 1 in assembled condition;

FIG. 3 is a sectional view along line III—III of FIG. 2;

FIGS. 4 and 5 are top and side views, respectively, of the base in the bell assembly of FIGS. 1 and 2;

FIGS. 6 and 7 are top and side views, respectively, of the hammer in the bell assembly of FIGS. 1 and 2; and FIGS. 8 and 9 are side views of the collar and of the push-button, respectively, in the bell assembly of FIGS. 1 and 2.

As shown particularly in FIGS. 1 and 2, the illustrated bell assembly includes five basic parts; a base 2; a metal bell 3 mounted on the base; a collar 4 mounting the bell to the base; a hammer 5 pivotally mounted on the base to strike the bell 3 when the hammer is actuated; and a manually depressible actuator 6 mounted on the base and manually depressible to actuate the hammer 5 to strike the bell 3. In the embodiment illustrated in the drawings, only the bell 3 is of metal; all the other parts are of plastic.

The base 2 is of circular shape and is formed with a depending peripheral flange 21, which serves as a support for supporting the bell assembly on a flat horizontal surface, such as a table. Base 2 is formed with a cut-out 22, and with a bridge 23 overlying one section 22*a* of the cut-out. Bridge 23 is formed with a pair of upstanding legs 24, 25, joined at one end to the base 2. The opposite ends of legs 24, 25 are joined by a flat ledge 26 formed with a hole 27 used for securing the bell 3 to the base 2, as will be described more particularly below. The other section 22*b* of cut-out 22 underlies the hammer 5, when in its normal non-operative position, and permits the hammer to be pivotted to strike the bell 3 by the depression of the actuator button 6.

The ends of the upstanding legs 24, 25 adjacent to ledge 26 are integrally formed with a pair of laterally-extending hooks 28, 29 for pivotally mounting hammer 5. The upper ends of hooks 28, 29, are spaced from the corresponding surfaces of the respective legs 24, 25 by tapered spaces, e.g., 29*a* (FIG. 5), to facilitate receiving the hammer in a snap-action manner as will be described more particularly below.

Bell 3, which as indicated above is the only metal part in the illustrated bell assembly, is of a conventional cup-shaped configuration, having a rounded top wall 31 and a depending side wall 32. Bell 3 is mounted to bridge 23 by the use of collar 4 as to be described below, such that the lower surface of the depending side wall 32 of the bell is slightly spaced from the upper surface of the base 2. Preferably, the outer diameter of the depending side wall 32 of the bell is slightly less than the outer diameter of base 2 so as to present a somewhat flush appearance to the bell and base of the bell assembly.

Bell 3 is formed with a central hole 33 of substantially the same diameter as central hole 27 in ledge 26 of base 2. The bell is mounted to bridge 23 of base 2 by the plastic collar 4 passing through the aligned holes 27 and 33.

Plastic collar 4 is constructed so as to be snap-fitted into the aligned hole 27 of the base bridge 23, and hole 33 of bell 3. Thus, collar 4 is integrally formed with an enlarged head 41 having a central hole 42 for receiving the actuator 6, and with defining one end of an axial bore formed through a depending stem 43 for insertion into the aligned holes 27 and 33 of the bridge 2 and bell 3, respectively. The end of stem 43 opposite to that of its enlarged head 41 is formed with an annular rib 44 defining the opposite end of the axial bore through the stem and having an outer diameter slightly larger than that of holes 27 and 33, permitting that end of the stem to be forcefully inserted through the holes. Annular rib 44 has a tapered surface 44*a* (FIG. 9) on the side thereof facing away from its enlarged head 41, to facilitate the forceful insertion of the collar through holes 27 and 33. The opposite side 44*b* of annular rib 44 (i.e. facing its enlarged head 41) is flat and perpendicular to the axis of the stem, to prevent the forceful removal of the collar from holes 27 and 33.

Hollow stem 43 of collar 4 is further formed with a pair of axial slits 45 terminating short of the enlarged head 41, to further facilitate the forceful insertion of the collar through the aligned holes.

Hammer 5 is of a dense plastic material, e.g. nylon. It is formed with a mounting section 51 having a pair of projections 52, 53, midway of the opposite sides of section 51. These projections are adapted to be received in hooks 28, 29 of the base 2, for pivotally mounting the hammer to the base.

Hammer 5 is further formed with an impact section 54 integral with, and substantially perpendicular to, the mounting section 51. Impact section 54 is of semi-cylindrical configuration, having an outer semi-cylindrical surface 54*a* (FIG. 6) which impacts the bell 3 when the hammer is actuated by depressing actuator button 6. The latter button overlies the opposite end 51*a* of section 51 such that a sharp depression of the button will pivot hammer 5 (clockwise in FIG. 3) about its pivot projections 52, 53, to cause the impact section 54 of the hammer to sharply impact against the inner surface of the bell 3.

The juncture 55 of the mounting section 51 and impact section 54 of hammer 5 is thickened to rigidify this juncture. The outer surface of this juncture is bevelled, as shown at 56, to space that surface from the inner surface of the bell when the hammer is actuated.

The depressible actuator button 6 is received within the axial bore 42 of collar 4. Button 6 includes an enlarged head 61, of larger diameter than the enlarged head 41 of collar 4, and a depending hollow stem 62 which terminates in an annular rib 63, similar to the construction in collar 4. Annular rib 63 permits the button to be forcefully inserted through the axial bore 42 of the collar but once inserted, prevents its removal from the collar. Thus, as shown particularly in FIG. 8, annular rib 63 of button 6 is also formed with a tapered surface 63*a* on the side there facing away from its enlarged head 61 to facilitate the insertion of the stem into axial bore 42, and with a flat surface 63*b* perpendicular to the axis of the stem, to prevent the forceful removal of button 6 once inserted into the collar. Button stem 62 is further formed with a pair of axial slits 64 terminating short of the enlarged head 61, to facilitate the insertion of the button stem into axial bore 42 of the collar.

Stem 62 of actuator button 6 is of longer length than stem 43 of collar 4, to permit the button to be depressed with respect to the collar. As indicated above, the end of the button stem 62 overlies the end 51*a* of the mounting section of the hammer 5, such that a sharp depression of the button will pivot the hammer to cause its impact section 54 to strike the bell 3. The pivot projections 52, 53, of hammer 5 are located such that the weight of the impact section 54, on one side of the pivot projections, is substantially greater than the portion of the hammer on the opposite side of the pivot projections, so that the weight of the impact section 54 normally pivots the hammer (counter-clockwise, FIG. 3), to bring the upper surface of the hammer mounting section 51 into light engagement with the end of the button stem 62.

The manner of assembling the parts of the bell assembly, and the manner of using the bell assembly, will be apparent from the above description. Thus, the bell is easily assembled by first applying the hammer 5 to the bridge 23 of the base 2. This is done by pressing the pivot projections 52, 53 of the hammer 5 through the tapered spaces (e.g., 29*a*) to seat them within the hooks 28, 29. The collar 4 is then forcefully inserted through hole 27 in bridge 23 of base 2, and hole 33 in the bell 3, while the two holes are in alignment. After the collar has thus been force-fitted through the two holes 27 and 33, the actuator button 6 is applied to the collar by forcefully passing its stem 62 through axial bore 42 in the collar. The tapered surfaces of annular rib 44 of the collar 4, and annular rib 63 of the button 6 (44*a*, 63*a*, respectively), facilitate the forceful application of the collar and button as described above, but once these parts have been so assembled, the opposite perpendicular faces of the two annular ribs (44*b*, 63*b*) prevent the removal of the collar and of the button.

In the assembled bell, the impact section 54 of the hammer 5 normally pivots the hammer so that the mounting section 51 is lightly urged against the bottom of the depressible button stem 62, such that a quick depression of the button pivots the hammer 5 (clockwise FIGS. 1, 2) to cause the hammer impact section 54 to strike the bell 3.

While the invention has been described to one preferred embodiment, it will be appreciated that this is set forth merely for purposes of example, and that many other variations, modifications and applications of the invention may be made.

What is claimed is:

1. A bell assembly, comprising:

a base having a bell-mounting element:

a metal bell mounted on said bell-mounting element of the base;

a hammer pivotally mounted on said base and pivotal, when actuated, to strike said bell;

and a manually depressible actuator mounted on said base and manually depressible to actuate said hammer to strike said bell;

characterized in that said bell is mounted on said base by means of a plastic collar snap-fitted into aligned holes in said bell and said bell mounting element of the base;

said plastic collar having a stem passing through said aligned holes in the bell and bell mounting element in the base;

one end of said stem being formed with an enlarged head engaging an outer surface of the bell;

the opposite end of said stem being formed with an annular rib slightly larger than said aligned holes permitting said opposite end of the stem to be forcefully inserted with a snap-action fit through said aligned holes and to engage an inner surface of the bell mounting element;

said collar being formed with an axial bore for receiving the manually depressible actuator.

2. The bell assembly according to claim 1, wherein said annular rib has a tapered surface on the side thereof facing away from said enlarged head to facilitate the forceful insertion of the collar through said aligned holes, and a flat surface on the opposite side, said flat surface being perpendicular to the stem axis, to prevent the forceful removal of the collar from said aligned holes.

3. The bell assembly according to claim 2, wherein said stem is formed with at least one axial slit terminating short of said enlarged head to further facilitate the forceful insertion of the collar through said aligned holes.

4. The bell assembly according to claim 3, wherein said stem is formed with two of said axial slits on diametrically opposite sides of said stem.

5. The bell assembly according to claim 1, wherein said actuator is a plastic button snap-fitted into said axial bore of the collar;

said plastic button including a stem longer than the stem of the collar to permit axial movement of the button within the collar in order to actuate the hammer;

said plastic button further including an enlarged head at one end of the stem manually engageable by a user to actuate the hammer, and an annular rib at the opposite end of the stem limitting the outward movement of the plastic button.

6. The bell assembly according to claim 5, wherein said annular rib of the plastic button has a tapered surface on the side thereof facing away from said enlarged head to facilitate the forceful insertion of the collar through said aligned holes, and a flat surface on the opposite side, said flat surface being perpendicular to the stem axis to prevent the forceful removal of the collar from said aligned holes.

7. The bell assembly according to claim 6, wherein said stem of the plastic button is formed with at least one axial slit terminating short of said enlarged head to further facilitate the forceful insertion of the collar through said aligned holes.

8. The bell assembly according to claim 7, wherein said stem of the plastic button is formed with two of said axial slits on diametrically opposite sides of said stem.

9. The bell assembly according to claim 1, wherein said base is also of plastic material, and said bell-mounting element thereof is a bridge integrally formed with the base;

said bridge including a pair of upstanding legs joined at one of their ends to the base;

said pair of upstanding legs being joined at their opposite ends by a flat ledge formed with said hole in the bell mounting element aligned with said hole in the bell receiving said plastic collar.

10. The bell assembly according to claim 9, wherein said opposite ends of said upstanding legs are integrally formed with laterally-extending hooks for pivotally mounting said hammer.

11. The bell assembly according to claim 10, wherein said base is formed with a cut-out for accommodating said hammer during its pivotal movement.

12. The bell assembly according to claim 11, wherein said hammer is also of a plastic material;

said hammer being formed with a mounting section having one end aligned with said depressible actuator, and a pair of projections at opposite sides for pivotally mounting the hammer on said hooks of the base;

said hammer being integrally formed with an impact section joined to said mounting section for impacting the bell when the hammer is pivotted by said depressible actuator.

13. The bell assembly according to claim 12, wherein said impact section of the hammer is of semi-cylindrical configuration and has an outer semi-cylindrical surface which impacts the bell.

14. The bell assembly according to claim 12, wherein said impact section of the hammer is perpendicular to said mounting section of the hammer.

15. The bell assembly according to claim 12, wherein the outer ends of said hooks define tapered spaces with respect to their upstanding legs, permitting the said projections of the hammer mounting section to be snap-fitted into said hooks.

16. The bell assembly according to claim 1, wherein said base is of circular shape and is formed with a depending annular flange for supporting the bell assembly on a flat horizontal surface.

17. A bell assembly, comprising:

a base having a bell-mounting element:

a metal bell mounted on said bell-mounting element of the base;

a hammer pivotally mounted on said base and pivotal, when actuated, to strike said bell;

and a manually depressible actuator mounted on said base and manually depressible to actuate said hammer to strike said bell;

characterized in that said base is of plastic material and said bell-mounting element thereof is a bridge integrally formed with the base;

said bridge including a pair of upstanding legs joined at one of their ends to the base;

said pair of upstanding legs being joined at their opposite ends by a flat ledge formed with a hole aligned with a hole in the bell, said aligned holes receiving a snap-fitted plastic collar.

18. The bell assembly according to claim 17, wherein said hammer is also of a plastic material;

said hammer being formed with a mounting section having one end aligned with said depressible actuator, and a pair of projections at the opposite sides for pivotally mounting the hammer on the base;

said hammer being integrally formed with an impact section joined to said mounting section for impacting the bell when the hammer is pivotted by said depressible actuator.

19. The bell assembly according to claim 18, wherein said impact section of the hammer is of semi-cylindrical configuration having an outer semi-cylindrical surface which impacts the bell.

20. The bell assembly according to claim 18, wherein said impact section of the hammer is perpendicular to said mounting section of the hammer.

* * * * *